US008419160B2

(12) United States Patent
Mantell et al.

(10) Patent No.: US 8,419,160 B2
(45) Date of Patent: Apr. 16, 2013

(54) METHOD AND SYSTEM FOR OPERATING A PRINTHEAD TO COMPENSATE FOR FAILED INKJETS

(75) Inventors: David A. Mantell, Rochester, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 55 days.

(21) Appl. No.: 13/155,858

(22) Filed: Jun. 8, 2011

(65) Prior Publication Data

US 2012/0313989 A1 Dec. 13, 2012

(51) Int. Cl.
*B41J 29/393* (2006.01)

(52) U.S. Cl.
USPC ..... 347/19

(58) Field of Classification Search ..... 347/9, 12, 347/14, 19, 40
See application file for complete search history.

(56) References Cited

U.S. PATENT DOCUMENTS

| | | | |
|---|---|---|---|
| 3,946,398 | A | 3/1976 | Kyser et al. |
| 4,907,013 | A | 3/1990 | Hubbard et al. |
| 4,963,882 | A | 10/1990 | Hickman |
| 5,581,284 | A | 12/1996 | Hermanson |
| 5,640,183 | A | 6/1997 | Hackleman |
| 6,215,557 | B1 | 4/2001 | Owens |
| 6,481,816 | B1 | 11/2002 | Oyen |
| 6,508,531 | B1 | 1/2003 | Gargir |
| 6,695,435 | B1 | 2/2004 | Cheng et al. |
| 6,739,690 | B1 | 5/2004 | Darling |
| 7,338,144 | B2 | 3/2008 | Mantell et al. |
| 2004/0119766 | A1 | 6/2004 | Shibata et al. |
| 2005/0105105 | A1 | 5/2005 | Vestjens et al. |
| 2005/0116981 | A1 | 6/2005 | Faken et al. |

*Primary Examiner* — An Do
(74) *Attorney, Agent, or Firm* — Maginot, Moore & Beck, LLP

(57) ABSTRACT

An inkjet printer has a printhead in which all of the inkjets are used for printing, but at a less than maximum available ejection output. When a failed inkjet is identified, the ejection throughput is increased for inkjets that print pixels in an at least two pixel neighborhood about a missing pixel, so the pixels to be printed by the failed inkjet are printed by inkjets that print pixels in the two pixel wide neighborhood.

20 Claims, 4 Drawing Sheets

METHOD AND SYSTEM FOR OPERATING A PRINTHEAD TO COMPENSATE FOR FAILED INKJETS

TECHNICAL FIELD

The system and method disclosed in this document relates to inkjet printing systems generally, and, more particularly, to systems and method for operating a printhead to enable some inkjets in the printhead to compensate for weak, missing, or intermittent inkjets in the printhead.

BACKGROUND

Drop-on-demand ink jet printing systems eject ink drops from printhead nozzles in response to pressure pulses generated within the printhead by either piezoelectric devices or thermal transducers, such as resistors. The printheads typically include a manifold that receives ink from an external ink supply and supplies ink to a plurality of pressure chambers. Each pressure chamber is fluidly coupled to the manifold by an inlet and by an outlet to a nozzle, which is an opening in an external surface of the printing system. On a side of the pressure chamber opposite the fluid path to the nozzle, a flexible diaphragm layer overlies the pressure chamber and the piezoelectric or thermal transducer is positioned over the diaphragm layer.

To eject an ink drop from a nozzle, an electrical firing signal activates the piezoelectric device or thermal transducer, which causes the piezoelectric or thermal transducer to bend the diaphragm layer into the pressure chamber. This movement urges ink out of the pressure chamber through the outlet to the nozzle where an ink drop is ejected. Each piezoelectric device or thermal transducer is individually addressable to enable the device or transducer to receive an electrical firing signal. Each structure comprised of a piezoelectric or thermal transducer, a diaphragm, a pressure chamber, and nozzle is commonly called an inkjet or jet. When the diaphragm rebounds to its original position, the ink volume in the pressure chamber is refilled by capillary action of the inlet from the manifold.

Inkjet printing technologies suffer from reliability concerns as one or more individual droplet ejecting nozzles may fail or malfunction in a printhead. In some cases, these failures are temporary because either a maintenance operation, such as a printhead purge, or the passage of time may enable the nozzles to recover and recommence operation. In some cases, however, the permanent failure of a single nozzle may force the replacement of an entire printhead. Most nozzle failures, temporary or permanent, are caused either by contamination, such as contaminants in ink or manufacturing debris, and external paper debris or by air bubbles either ingested or forming near the nozzles. Nozzle failures are generally proportional to print throughput, so the higher the printing volume, the more likely a nozzle will fail. The permanent failure of a single nozzle may require the replacement of a printhead because the resulting missing line or column of pixels can be visually objectionable. Even temporary nozzle failures may result in a portion or all of a print job being discarded. Many attempts in the inkjet industry have been made to compensate for missing nozzles without either having to replace the printhead or perform a maintenance operation before printing can resume. Of course, more robust systems capable of compensating for missing or malfunctioning nozzles without requiring printhead replacement or maintenance operations are desirable.

SUMMARY

An inkjet printer has been developed that increases inkjet ejection throughput to compensate for missing, weak, or intermittent inkjets in a printhead. The system includes a first printhead having a first array of inkjets from which ink is ejected, an optical sensing system configured to generate image data of ink ejected onto an image receiving member by the first array of inkjets in the first printhead, and a controller operatively connect to the first printhead and the optical sensing system, the controller being configured to operate the first printhead to eject ink droplets from the inkjets of the first array of inkjets in the first printhead during a printing operation at an ejection throughput of about 0.75 to 0.95 of a maximum available throughput of the first printhead, to process image data received from the optical sensing system to identify at least one missing pixel and detect at least one failed inkjet in the first array of inkjets in the first printhead that corresponds to the at least one missing pixel, and to operate inkjets in the first array of inkjets in the first printhead that print pixels that are within a neighborhood of at least two pixel positions about each at least one missing pixel at an increased ejection throughput to eject ink droplets within the at least two pixel position neighborhood about each missing pixel in response to the controller detecting at least one failed inkjet from the at least one missing pixel.

A method has also been developed that uses increased inkjet ejection throughput to compensate for missing, weak, or intermittent inkjets in a printhead. The method includes operating all inkjets in an array of inkjets in a first printhead to eject ink droplets at an ejection throughput that is on average greater than 0.75 to 0.95 of a maximum available throughput of the inkjets in the array of inkjets while printing an image without a failed inkjet, detecting a failed inkjet in the array of inkjets in the first printhead, identifying missing pixels intended to be printed by the failed inkjet, selecting operational inkjets in the array of inkjets that print pixels within a neighborhood of at least two pixel positions about each identified missing pixel, and operating the selected operational nozzles at an increased ejection throughput to eject ink droplets within the at least two pixel position neighborhood about each identified missing pixel.

BRIEF DESCRIPTION OF THE DRAWINGS

An exemplary embodiment of this application will now be described, by way of example, with reference to the accompanying drawings, in which like reference numerals refer to like elements, and in which.

DETAILED DESCRIPTION

Figure 3:
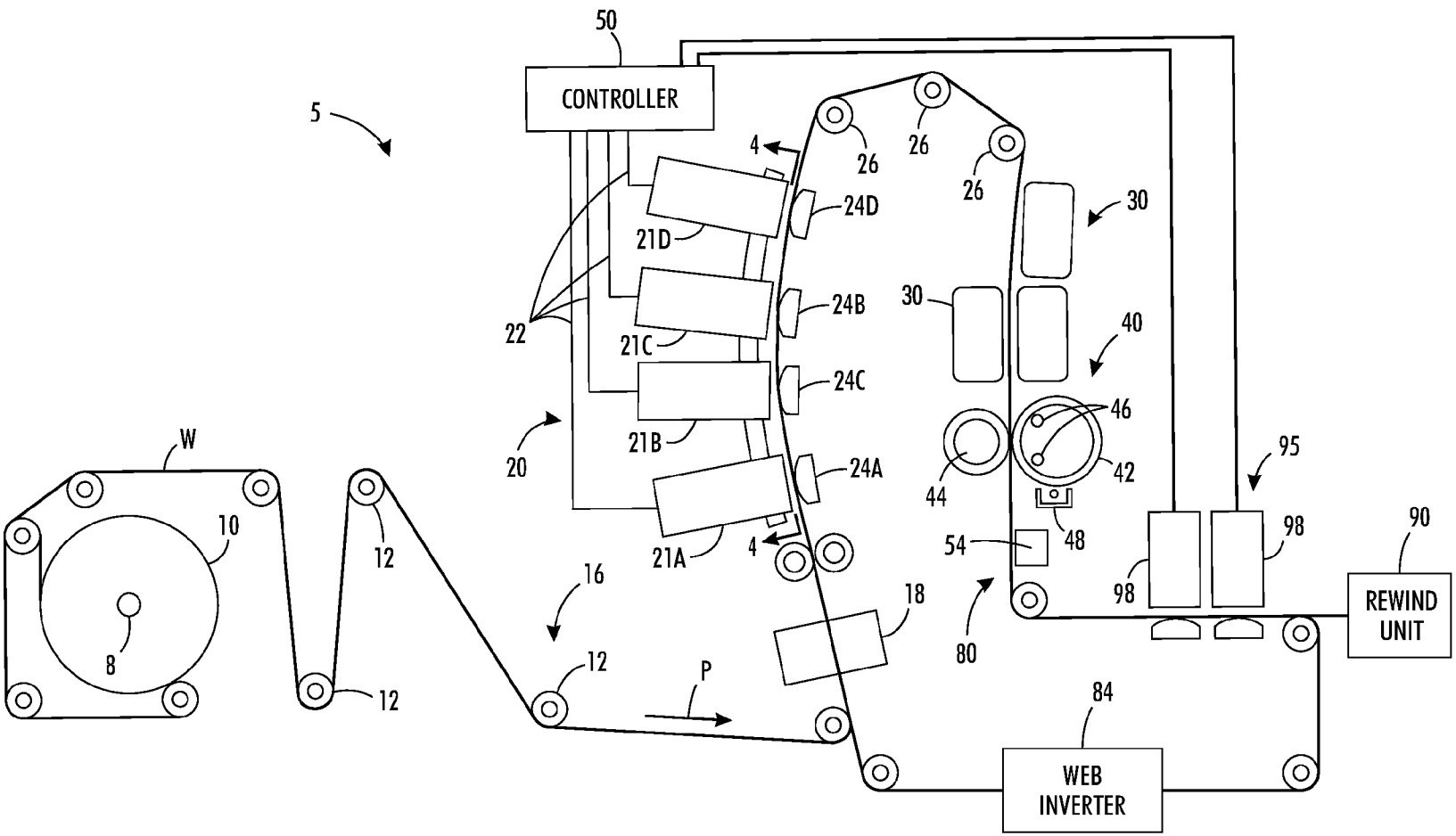
FIG. 3 is a schematic view of an improved inkjet imaging system that ejects ink onto a continuous web of media as the media moves past the printheads in the system.

Referring to FIG. 3, an inkjet imaging system 5 is shown. For the purposes of this disclosure, the imaging apparatus is in the form of an inkjet printer that employs one or more inkjet printheads and an associated solid ink supply. The controller, discussed in more detail below, may be configured to implement a process that generates firing signals to operate inkjets in at least one printhead in the system to compensate for inkjets in the printhead that have been detected as malfunctioning. The processes described herein are applicable to any of a variety of other imaging apparatus that use inkjets to eject one or more colorants to a medium or media. For example, while the system and method described below are particularly directed to a direct to media printing system, the system and method may be adapted to indirect printers that form an ink image on a rotating image member and then transfer the ink image from the image member to media.

The imaging apparatus 5 includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The preheater 18 may use contact, radiant, conductive, or convective heat to bring the media to a target preheat temperature, which in one practical embodiment, is in a range of about 30° C. to about 70° C.

The media is transported through a printing station 20 that includes a series of color units 21A, 21B, 21C, and 21D, each color unit effectively extending across the width of the media and being able to place ink directly (i.e., without use of an intermediate or offset member) onto the moving media. The arrangement of printheads in the print zone of system 5 is discussed in more detail with reference to FIG. 4. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four color units to calculate the linear velocity and position of the web as moves past the printheads. The controller 50 uses these data to generate timing signals for actuating the inkjet ejectors in the printheads to enable the four colors to be ejected with a reliable degree of accuracy for registration of the differently colored patterns to form four primary-color images on the media. The inkjet ejectors actuated by the firing signals correspond to image data processed by the controller 50. The image data may be transmitted to the printer, generated by a scanner (not shown) that is a component of the printer, or otherwise generated and delivered to the printer. In various possible embodiments, a color unit for each primary color may include one or more printheads; multiple printheads in a color unit may be formed into a single row or multiple row array; printheads of a multiple row array may be staggered; a printhead may print more than one color; or the printheads or portions of a color unit may be mounted movably in a direction transverse to the process direction P, such as for spot-color applications and the like.

Each of color units 21A-21D includes at least one actuator configured to adjust the printheads in each of the printhead modules in the cross-process direction across the media web. In a typical embodiment, each motor is an electromechanical device such as a stepper motor or the like. One embodiment illustrating a configuration of print bars, printheads, and actuators is discussed below with reference to FIG. 2. In a practical embodiment, a print bar actuator is connected to a print bar containing two or more printheads. The print bar actuator is configured to reposition the print bar by sliding the print bar along the cross-process axis of the media web. Printhead actuators may also be connected to individual printheads within each of color units 21A-21D. These printhead actuators are configured to reposition an individual printhead by sliding the printhead along the cross-process axis of the media web. In this specific embodiment the printhead actuators are devices that physically move the printheads in the cross process direction. In alternative embodiments, an actuator system may be used that does not physically move the printheads, but redirects the image data to different ejectors in each head to change head position. Such an actuator system, however, can only reposition the printhead in increments that correspond to ejector to ejector spacing in the cross process direction.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color unit is a backing member 24A-24D, typically in the form of a bar or roll, which is arranged substantially opposite the color unit on the back side of the media. Each backing member is used to position the media at a predetermined distance from the printheads opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the color units, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the color units. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to −10° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 3, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink or varnish that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks, such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the processes for identifying malfunctioning inkjets and operating neighboring inkjets to compensate for the loss of the malfunctioning inkjets. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively coupled to the print bar and printhead actuators of color units 21A-21D in order to adjust the position of the print bars and printheads in the cross-process direction.

The imaging system 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system may be a single light source, such as a light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

Figure 4:
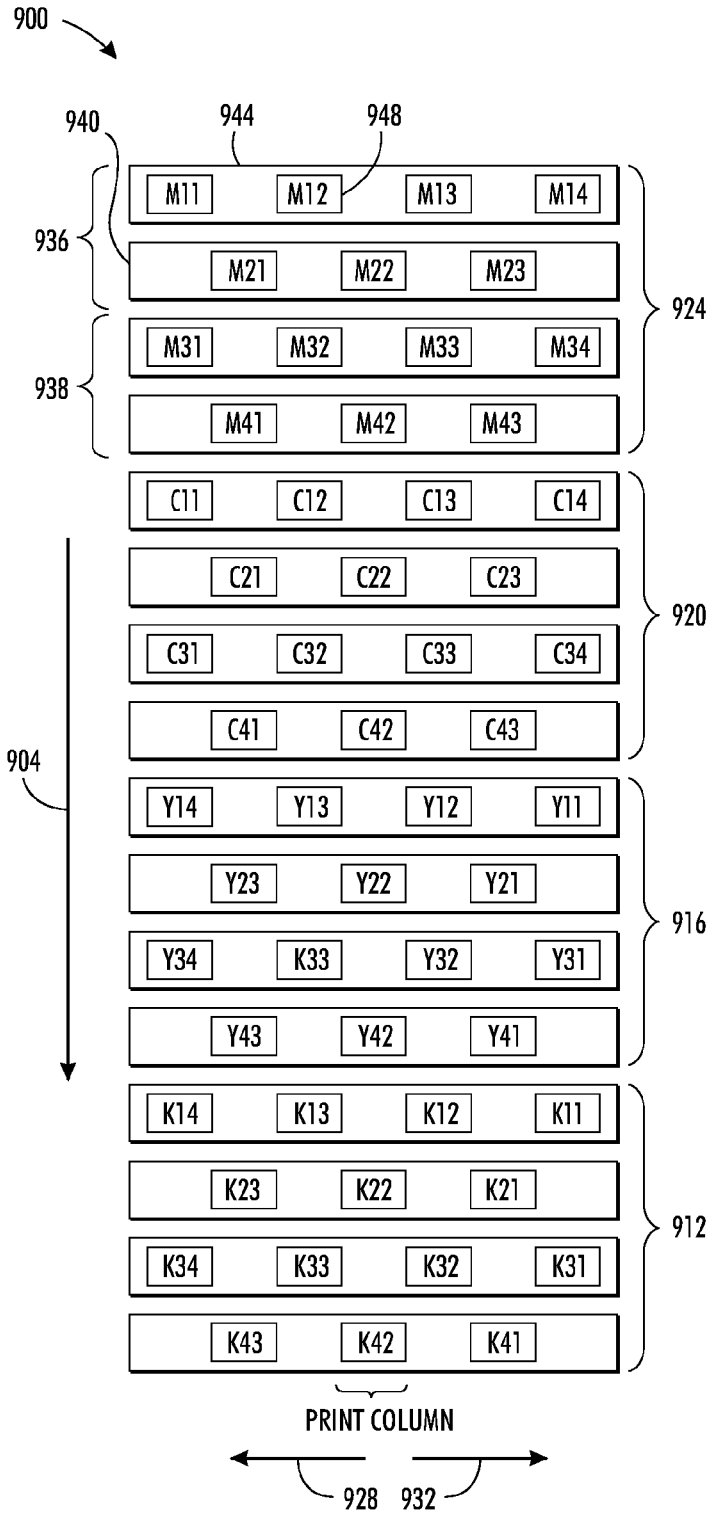
FIG. 4 PRIOR ART
FIG. 4 is a schematic view of a printhead configuration viewed along lines 4-4 in FIG. 3.

A schematic view of a prior art print zone 900 is depicted in FIG. 4. The print zone 900 includes four color units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as the member travels under the color units from color unit 924 to color unit 912. Each color unit includes two print bar arrays, each of which includes two print bars that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

Figure 2:
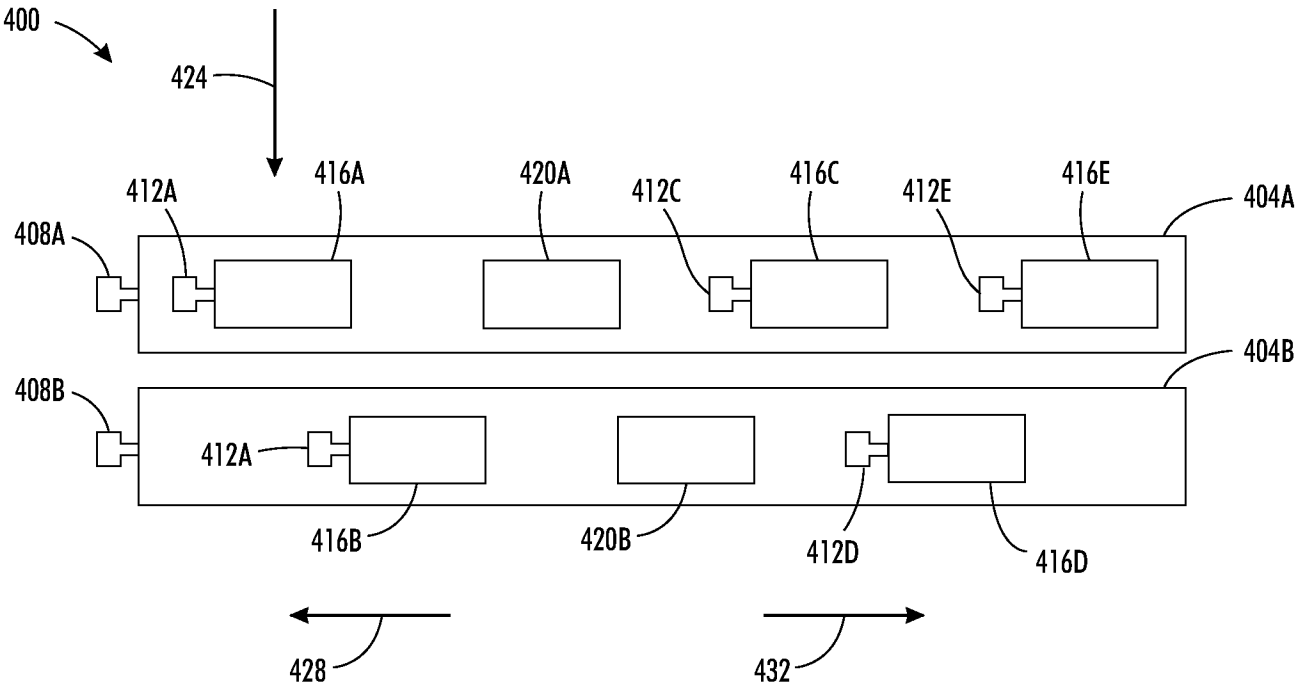
FIG. 2 is a schematic view of a print bar unit.

FIG. 2 depicts a configuration for a pair of print bars that may be used in a color unit of the system 5. The print bars 404A and 404B are operatively connected to the print bar motors 408A and 408B, respectively, and a plurality of printheads 416A-E and 420A, 420B are mounted to the print bars. Printheads 416A-E are operatively connected to electrical motors 412A-E, respectively, while printheads 420A and 420B are not connected to electrical motors, but are fixedly mounted to the print bars 404A and 404B, respectively. Each print bar motor moves the print bar operatively connected to the motor in either of the cross-process directions 428 or 432. Printheads 416A-416E and 420A-420B are arranged in a staggered array to allow inkjet ejectors in the printheads to print a continuous line in the cross-process direction across a media web. As used in this document, a "print bar array" refers to the printheads mounted to two adjacent print bars in the process direction that eject the same color of ink. Movement of a print bar causes all of the printheads mounted on the print bar to move an equal distance. Each of printhead motors 412A-412E moves an individual printhead in either of the cross-process directions 428 or 432. Motors 408A-408B and 412A-412D are electromechanical stepper motors capable of rotating a shaft, for example shaft 414, in a series of one or more discrete steps. Each step rotates the shaft a predetermined angular distance and the motors may rotate in either a clockwise or counter-clockwise direction. The rotating shafts turn drive screws that translate print bars 404A-404B and printheads 416A-416E along the cross-process directions 428 and 432.

While the print bars of FIG. 2 are depicted with a plurality of printheads mounted to each print bar, one or more of the print bars may have a single printhead mounted to the bar.

Such a printhead would be long enough in the cross-process direction to enable ink to be ejected onto the media across the full width of the document printing area of the media. In such a print bar unit, an actuator may be operatively connected to the print bar or to the printhead. A process may be used to position such a wide printhead with respect to multiple printheads mounted to a single print bar or to other equally wide printheads mounted to other print bars. The actuators in such a system enable the inkjet ejectors of one printhead to be interlaced or aligned with the inkjet ejectors of another printhead in the process direction.

Figure 1:
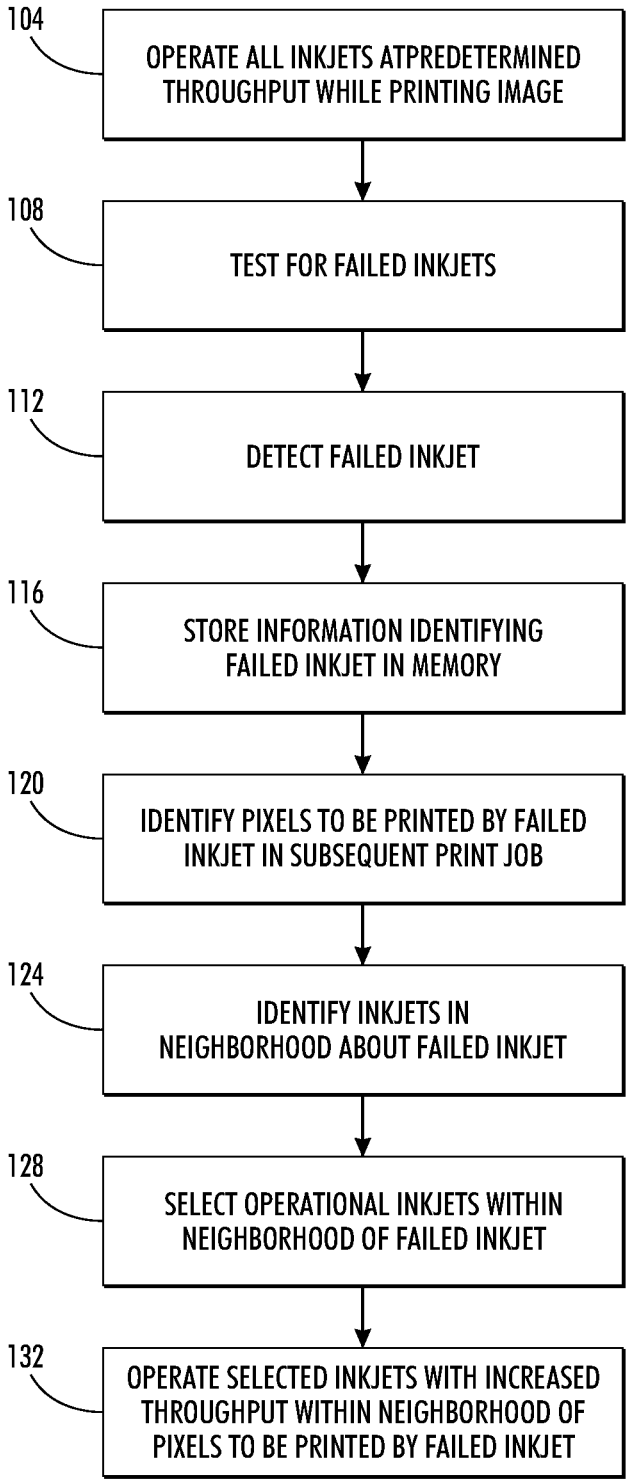
FIG. 1 is a flow diagram of a process that enables inkjets in a printhead to be operated at an increased ejection throughput to compensate for failed inkjets in the printhead.

A method of printing images by printing system described above is able to compensate for failed inkjets by operating selected operational inkjets in a neighborhood about any failed inkjet. In various embodiments, the neighboring jets are in the same printhead array while in other embodiments, they are in a sequential interlaced array, such as the printheads M12 to M32 in FIG. 4. The method is shown in FIG. 1 and is used in a printing system such as the one shown in FIG. 3. The method includes operating all of the inkjets in the array of inkjets to eject ink droplets at an ejection throughput in high density image areas that are on average greater than 0.75 to 0.95 of a maximum available throughput of ink drops produced by the array of inkjets while printing an image without a failed inkjet (block 104). That is, one or more controllers operate the inkjets of the printheads in the printing system at an ejection throughout that is about 75 percent to about 95 percent of a maximum throughput of the inkjets as long as no inkjet is detected as being a failed inkjet. The method continues by testing for failed inkjets (block 108). The failed inkjet testing in one embodiment is performed by printing a test pattern in a inter-document zone, generating image data of the printed test pattern with the optical imaging system described above, and processing the image data to detect missing pixels in the test pattern that indicate an inoperative inkjet. Such test patterns and imaging data processes are well known in the printing art. Upon detection of a failed inkjet in the array of inkjets (block 112), information identifying the inoperative inkjet is stored in a memory operatively connected to a controller in the printing system (block 116). In subsequent image processing to perform a printing operation, pixels to be printed by any failed inkjet are identified (block 120). The controller configured with programmed instructions and appropriate interface circuits to implement the process of FIG. 1 then identifies a neighborhood about each failed inkjet (block 124). As used in this document "neighborhood" refers to a group of inkjets positioned to eject ink drops for at least two positions to the left and at least two positions to the right of the failed inkjet. Neighborhoods in some embodiments extend for more than two pixel positions, but a minimum size for a neighborhood is two pixel positions. Within the neighborhood identified about a failed inkjet, operational inkjets in the array of inkjets that print pixels within the neighborhood are selected (block 128). These selected operational inkjets are operated at an increased ejection throughput to eject ink droplets within the two pixel position neighborhood about each identified pixel to be printed by a failed inkjet (block 132).

In one embodiment each printing pixel that corresponds to a failed inkjet is shifted to a physically close but otherwise non-printing pixel position that belongs to an inkjet in the failed inkjet's neighborhood. This shift of the printing pixel is done in either the process or the cross process direction and is as close to the original printing pixel location as possible. Because the nominal maximum fill rate of pixels is at most 75%-95% rather than 100%, positions are available in the neighboring pixels in which the pixels for the failed inkjet can be shifted. A higher operating maximum fill rate can cause the pixels to be shifted further from the original position than they are shifted at lower operating maximum fill rates.

In some embodiments, the identification of the missing pixels (block 128) includes detecting whether the missing pixels are being printed in a high density area. A high density area, as used in this document, refers to an area of an image where the average number of open pixels in the neighborhood is less than or equal to the average number of printed pixels that would be printed by a single jet. In response to the missing pixels being printed in a high density area the ejection throughput for the selected operational inkjets is increased to the maximum available throughput for the inkjets.

Empirical study has determined that the compensation method for inoperative inkjets may result in visible defects when the resolution of the pixels in the cross-process direction is below a threshold. In one study, the compensation method described above did not produce visible defects in resolutions of 600 dpi or higher. The term "dpi" refers to the number of dots or pixels per inch of the printhead array of a particular color. While known methods can arrange inkjets in rows within one printhead to be offset from the inkjets in a row in another printhead by an interval that is smaller than the spacing between inkjets in a row to increase resolution in the cross-process direction, the issue of providing adequate resolution in the process direction cannot be addressed by those methods. If fine lines or edges are to be printed, then the throughput needs to be increased to avoid generating visible defects. Moving drops too far from an edge to compensate for missing inkjets is not desireable. Thus, the processing of block 128 in some embodiments includes identification of missing pixels in fine lines or edges. In response, the selected operational inkjets in the neighborhood are operated at a higher throughput in the area of the fine line or edge, but compensation is limited to only a single pixel from the missing inkjet. This manner of operation enables the missing pixels associated with the failed inkjet to be printed by the selected operational inkjets while limiting the visible defects in the fine lines or edges. Hence one embodiment also enables the processing described with reference to blocks 104 and 132 to arrange the pixels for the one or more failed inkjets in any given image to preserve an edge or provide a predetermined edge smoothness. For example, edge enhancement processing in one embodiment produces an image that prints all of the pixels at or near to an edge, but only prints 75%-95% of the pixels within the interior of the area defined by the edge or edges. A fine line, as used in this document, refers to a line or curve in which all of the pixels are at a high contrast relative to background pixels. The higher throughput is used in the process direction within an image in one embodiment. Different higher throughputs are used in different areas of an image and for different printheads ejecting different colors of ink in another embodiment.

The increased ejection throughput enables the inkjets in the neighborhood of a failed inkjet to eject a portion of the ink that would have been ejected by the failed inkjet. By spreading the amount of ink that would have been printed by the failed inkjet over a larger neighborhood than simply the nearest neighbor inkjets immediately adjacent the failed inkjet, the inkjets in the printhead can be operated at a higher ejection throughput before detection of a failed inkjet. Of course, a practical limit exists for the neighborhood range because inkjets at too great a distance from the failed inkjet do not eject ink close enough to where the failed inkjet would have ejected ink to address the visual discrepancy that would occur if no compensation was made for the failed inkjet.

In the printing system described above, the method results in the ejection of ink droplets onto a recording medium as the recording medium travels past the array of inkjets in a process direction. In other embodiments, a controller in an indirect printing system can be configured with programmed instructions and appropriate interface circuits to detect failed inkjets, identify missing pixels to be printed by the failed inkjets, and compensate for the failed inkjets by distributing the ink to be ejected for the missing pixels over the inkjets in a neighborhood about the failed inkjet.

The print zone of the inkjet printer shown in FIG. 4 includes at least one printhead having a first array of inkjets from which ink is ejected that is aligned in the process direction with at least a portion of the inkjets in the first array of inkjets in the first printhead. The optical sensing system described above is configured to generate image data of ink ejected onto an image receiving member, such as media, by the first array of inkjets in the at least one printhead. The controller of the system 5 is operatively connect to the at least one printhead and the optical sensing system. This controller is configured by programmed instructions stored in a memory accessed by the controller and appropriate interface circuits to operate the at least one printheads to eject ink droplets from the inkjets of the first array of inkjets in the first printhead during a printing operation at an ejection throughput of about 0.75 to 0.95 of a maximum available throughput of the printheads. The controller is also configured to process image data received from the optical sensing system to identify at least one missing pixel and detect at least one failed inkjet in the inkjets of at least one printhead that corresponds to the at least one missing pixel. The controller is also configured to operate inkjets in the first array of inkjets in the first printhead that print pixels that are within a neighborhood of at least two pixel positions about each at least one missing pixel at an increased ejection throughput to eject ink droplets within the at least two pixel position neighborhood about each missing pixel in response to the controller detecting at least one failed inkjet from the at least one missing pixel.

In some embodiments, the controller is operatively connected to a memory configured to store failed inkjet identifying information. The controller is further configured to store failed inkjet identifying information in the memory and to operate the inkjets in the first array of inkjets in the first printhead that print pixels within a neighborhood of at least two pixel positions about the at least one missing pixel at an increased ejection throughput to eject ink droplets within the at least two pixel position neighborhood in response to the controller detecting the failed inkjet from the failed inkjet identifying information stored in the memory. The controller, in some embodiments, is configured to select inkjets in the first array of inkjets in the first printhead for increased ejection throughput with reference to the at least one missing pixel. The controller then operates the selected inkjets at the maximum available throughput in response to the at least one missing pixel being in a high density area.

The controller is also configured in some embodiments to operate the inkjets in the first array of inkjets in the first printhead to generate a test pattern in an inter-document zone on media traveling past the first array of inkjets in the first printhead and to process image data of the test pattern on the media received from the optical sensing system to identify at least one missing pixel in the test pattern. The controller then detects the at least one failed inkjet in the first printhead that corresponds to the identified at least one missing pixel and selects the operational inkjets that are used to compensate for the detected failed inkjets.

In some embodiments, each printhead color array is operated with different maximum throughput rates and one or more of the printhead color arrays can be operated without reference to the above described method of failed inkjet compensation. Also, some embodiments operate one or more printhead color arrays with reference to different maximum throughput rates for different portions of the images. The different portions in one embodiment are defined with reference to image type, such as graphics or fonts, while other embodiments use other criteria for identified different image portions. Additionally, some embodiments use maximum throughput rates above the 0.75 and 0.95 values for some images or image types, including up to 100%.

In operation, a controller of an inkjet printer operates the inkjets of the printheads in the inkjet printer at an ejection throughput of about 0.75 to about 0.95 of a maximum available throughput of the inkjets. The controller prints test pattern data that is imaged by an optical sensing system and the image data is processed by the controller to identify missing pixels to detect failed inkjets corresponding to the missing pixels. The controller then selects operational inkjets that print pixels in the neighborhoods of pixels about the missing pixels that are at least two pixels in length on each side of a missing pixel. These selected inkjets are operated at higher ejection throughputs to compensate for the missing pixels that should have been ejected by one or more failed inkjets corresponding to the missing pixels. The information identifying the failed inkjets may be stored in a memory and accessed by the controller to select and compensate for failed inkjets during later printing operations. If previously missing pixels reappear in test patterns later printed, the controller may overwrite the data in the memory corresponding to the failed inkjet to indicate the inkjet is no longer failed.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A method of printing images with an inkjet printer comprising:

operating all inkjets in an array of inkjets in a first printhead to eject ink droplets at an ejection throughput that is on average greater than 0.75 to 0.95 of a maximum available throughput of the inkjets in the array of inkjets while printing an image without a failed inkjet;

detecting a failed inkjet in the array of inkjets in the first printhead;

identifying missing pixels intended to be printed by the failed inkjet;

selecting operational inkjets in the array of inkjets that print pixels within a neighborhood of at least two pixel positions about each identified missing pixel; and operating the selected operational nozzles at an increased ejection throughput to eject ink droplets within the at least two pixel position neighborhood about each identified missing pixel.

2. The method of printing in claim 1, the operation of the selected operational nozzles at the increased ejection throughput further comprises:

operating the selected operational inkjets at the maximum available throughput in response to the identified missing pixels being in a high density area of an image to be printed.

3. The method of printing in claim 1 further comprising:

ejecting the ink droplets onto a recording medium as the recording medium travels past the array of inkjets in the first printhead in a process direction.

4. The method of printing in claim 1, the detection of the failed inkjet further comprises:

printing a test pattern in an inter-document zone on media traveling past the array of inkjets in the first printhead;

generating image data of the test pattern on the media; and processing the image data to identify missing pixels in the test pattern and detect the failed inkjet.

5. The method of claim 1, the selected operational inkjets being operated at a higher ejection throughput in a process direction at an edge in the image being printed.

6. The method of claim 1, the selected operational inkjets being operated at a higher ejection throughput for different portions of the image being printed.

7. The method of claim 1, the selected operational inkjets being operated at a higher ejection throughput for the first printhead ejecting a first color of ink and at a second higher ejection throughput for a second printhead ejecting a second color of ink for the image being printed.

8. An inkjet printer comprising:

a first printhead having a first array of inkjets from which ink is ejected;

an optical sensing system configured to generate image data of ink ejected onto an image receiving member by the first array of inkjets in the first printhead; and a controller operatively connect to the first printhead and the optical sensing system, the controller being configured to operate the first printhead to eject ink droplets from the inkjets of the first array of inkjets in the first printhead during a printing operation at an ejection throughput of about 0.75 to 0.95 of a maximum available throughput of the first printhead, to process image data received from the optical sensing system to identify at least one missing pixel and detect at least one failed inkjet in the first array of inkjets in the first printhead that corresponds to the at least one missing pixel, and to operate inkjets in the first array of inkjets in the first printhead that print pixels that are within a neighborhood of at least two pixel positions about each at least one missing pixel at an increased ejection throughput to eject ink droplets within the at least two pixel position neighborhood about each missing pixel in response to the controller detecting at least one failed inkjet from the at least one missing pixel.

9. The inkjet printer of claim 8 further comprising:

a memory operatively connected to the controller; and the controller is further configured to store failed inkjet identifying information in the memory and to operate the inkjets in the first array of inkjets in the first printhead that print pixels within a neighborhood of at least two pixel positions about the at least one missing pixel at an increased ejection throughput to eject ink droplets within the at least two pixel position neighborhood in response to the controller detecting the failed inkjet from the failed inkjet identifying information stored in the memory.

10. The inkjet printer of claim 8, the controller being further configured to select inkjets in the first array of inkjets in the first printhead for increased ejection throughput with reference to the at least one missing pixel.

11. The inkjet printer of claim 10, the controller being configured to operate the selected inkjets at the maximum available throughput in response to the at least one missing pixel being in a high density area.

12. The inkjet printer of claim 8, the controller being configured to operate the inkjets in the first array of inkjets in the first printhead to eject ink droplets onto a recording medium as the recording medium travels past the first printhead in a process direction.

13. The inkjet printer of claim 8, the controller being further configured to operate the inkjets in the first array of inkjets in the first printhead to generate a test pattern in an inter-document zone on media traveling past the first array of inkjets in the first printhead and to process image data of the test pattern on the media received from the optical sensing system to identify at least one missing pixel in the test pattern and detect the at least one failed inkjet in the first printhead that corresponds to the identified at least one missing pixel.

14. The inkjet printer of claim 8, the controller being further configured to operate the selected operational inkjets of a first printhead at a higher ejection throughput for different portions of the image being printed.

15. The inkjet printer of claim 8, the controller being further configured to operate the selected operational inkjets of the first printhead at a first predetermined maximum throughput rate and to operate selected operational inkjets of a second printhead at a second predetermined maximum throughput rate.

16. An inkjet printer comprising:

a first printhead having an array of inkjets from which ink is ejected;

a memory configured to store failed inkjet identifying information; and a controller operatively connected to the memory and the first printhead, the controller being configured to operate the first printhead to eject ink droplets from the inkjets of the array of inkjets in the first printhead during a printing operation at an ejection throughput of about 0.75 to 0.95 of a maximum available throughput of the first printhead, to access the failed inkjet identifying information stored in the memory and to operate the inkjets in the inkjet array of the first printhead that print pixels that are within a neighborhood of at least two pixel positions about at least one missing pixel corresponding to a failed inkjet identified by the information stored in the memory at an increased ejection throughput to eject ink droplets within the at least two pixel position neighborhood about the at least one missing pixel in response to the controller detecting a failed inkjet in the first printhead from the failed inkjet identifying information stored in the memory.

17. The inkjet printer of claim 16 further comprising:

an optical sensing system operatively connected to the controller, the optical sensing system being configured to generate image data of ink ejected onto an image receiving member by the array of inkjets in the first printhead; and the controller being further configured to process image data received from the optical sensing system to identify at least one missing pixel with reference to the image data and detect a failed inkjet in the array of inkjets in the first printhead that corresponds to the at least one missing pixel, and to operate inkjets in the inkjet array of the first printhead that print pixels that are within a neighborhood of at least two pixel positions about the at least one missing pixel identified with reference to the image data at an increased ejection throughput to eject ink droplets within the at least two pixel position neighborhood about each identified missing pixel in response to the controller detecting a failed inkjet from the at least one missing pixel.

18. The inkjet printer of claim 16, the controller being further configured to select inkjets in the array of inkjets in the first printhead for increased ejection throughput with reference to the at least one missing pixel.

19. The inkjet printer of claim 16, the controller being configured to operate the selected inkjets at the maximum available throughput in response to the at least one missing pixel being in a high density area.

20. The inkjet printer of claim 16, the controller being further configured to operate the inkjets in the array of inkjets in the first printhead to generate a test pattern in an inter-document zone on media traveling past the array of inkjets in the first printhead and to process image data of the test pattern on the media received from the optical sensing system to identify at least one missing pixel in the test pattern and detect the at least one failed inkjet in the first printhead that corresponds to the identified at least one missing pixel.

* * * * *